US009592839B2

(12) United States Patent
Hirashima et al.

(10) Patent No.: US 9,592,839 B2
(45) Date of Patent: Mar. 14, 2017

(54) RAILCAR

(71) Applicant: KAWASAKI JUKOGYO KABUSHIKI KAISHA, Kobe-shi, Hyogo (JP)

(72) Inventors: Toshiyuki Hirashima, Kobe (JP); Shirou Honma, Kobe (JP); Hitoshi Nagahara, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 101 days.

(21) Appl. No.: 14/389,827

(22) PCT Filed: Mar. 21, 2013

(86) PCT No.: PCT/JP2013/001936
§ 371 (c)(1),
(2) Date: Oct. 1, 2014

(87) PCT Pub. No.: WO2013/150736
PCT Pub. Date: Oct. 10, 2013

(65) Prior Publication Data

US 2015/0047530 A1 Feb. 19, 2015

(30) Foreign Application Priority Data

Apr. 2, 2012 (JP) ..... 2012-083959

(51) Int. Cl.
*B61D 17/10* (2006.01)
*B61F 1/12* (2006.01)
(Continued)

(52) U.S. Cl.
CPC ..... *B61D 17/10* (2013.01); *B61F 1/00* (2013.01); *B61F 1/10* (2013.01); *B61F 1/12* (2013.01)

(58) Field of Classification Search
CPC ..... B61F 1/10
(Continued)

(56) References Cited

U.S. PATENT DOCUMENTS 2,294,357 A * 8/1942 Dean ..... B61D 17/046 105/396
2,331,891 A * 10/1943 Dean ..... B61F 1/10 105/414
(Continued)

FOREIGN PATENT DOCUMENTS

CN 202138384 U 2/2012
JP 57-113265 1/1956
(Continued)

OTHER PUBLICATIONS

Jun. 25, 2013 International Search Report issued in PCT/JP2013/001936.
(Continued)

*Primary Examiner* — Zachary Kuhfuss
(74) *Attorney, Agent, or Firm* — Oliff PLC

(57) ABSTRACT

A railcar includes: a pair of side sills extending in a railcar longitudinal direction; end beams respectively located at railcar-longitudinal-direction end portions of the side sills to extend in a railcar width direction; bolster beams located at a railcar-longitudinal-direction inner side of the end beams to extend in the railcar width direction and respectively placed on bogies; center sills each located between the end beam and the bolster beam to extend in a railcar longitudinal direction; a plurality of cross beams located at a railcar-longitudinal-direction inner side of the bolster beams to extend in the railcar width direction; and a corrugated plate fixed to upper surfaces of the cross beams to be displaceable relative to the bolster beams in the railcar longitudinal direction.

9 Claims, 3 Drawing Sheets

(51) Int. Cl.
*B61F 1/10* (2006.01)
*B61F 1/00* (2006.01)

(58) Field of Classification Search
USPC ..... 105/413, 421, 422
See application file for complete search history.

(56) References Cited

U.S. PATENT DOCUMENTS 2,504,112 A * 4/1950 Dean ..... B61F 1/10 105/414
2,589,996 A * 3/1952 Dean ..... B61F 1/10 105/420
2,646,009 A * 7/1953 Dean ..... B61F 1/10 105/420
2,946,297 A * 7/1960 Dean ..... B61D 1/00 105/345
4,645,258 A * 2/1987 Ohmura ..... B62D 25/2054 105/422
4,794,032 A * 12/1988 Fujii ..... B61D 17/10 105/396
4,966,082 A * 10/1990 Takeichi ..... E04B 1/34336 105/422
5,287,814 A * 2/1994 Masai ..... B61D 17/04 105/418
5,918,549 A * 7/1999 Basile ..... B61D 17/10 105/422
6,000,342 A * 12/1999 Thoman ..... B61D 17/04 105/404
6,722,288 B2 * 4/2004 Beers ..... B61F 1/02 105/413

FOREIGN PATENT DOCUMENTS

JP A-62-31557 2/1987
JP A-07-017398 1/1995
JP A-7-096835 4/1995

OTHER PUBLICATIONS

Jan. 26, 2015 Office Action issued in Taiwanese Application No. 102110448.

* cited by examiner

RAILCAR

TECHNICAL FIELD

The present invention relates to a railcar, particularly to a railcar that deals with a compressive load acting on a railcar end portion.

BACKGROUND ART

Typically known as the structure of a railcar is a structure in which a keystone plate is arranged on an underframe constituted by end beams, side sills, center sills, bolster beams, and cross beams. Since a high compressive load acts on a railcar end portion of the underframe, a structure in which the stiffness and strength of the underframe are increased has been proposed (see PTL 1, for example). In the underframe described in PTL 1, a longitudinal frame member made of a fiber-reinforced composite material is provided at the center sill arranged between the bolster beams. With this, the underframe described in PTL 1 has a structure advantageous to a high railcar end load.

CITATION LIST

Patent Literature

PTL 1: Japanese Laid-Open Patent Application Publication No. 7-17398

SUMMARY OF INVENTION

Technical Problem

According to the railcar described in PTL 1, the buckling strength of the center sill can be improved. However, since the keystone plate is arranged over the entire length of the carbody, the keystone plate may buckle or permanently deform by the application of a compressive load before the other members buckle or permanently deform.

In order to prevent the keystone plate from buckling or permanently deforming, the thickness of the keystone plate may be increased, or the height (hereinafter referred to as a "wave height") of a convex portion of the keystone plate may be increased. However, there is a problem that if the wave height is increased, the position of the floor surface moves up, and this reduces a railcar inner space. There is another problem that if the thickness of the keystone plate is increased, the fixing of the keystone plate by series spot welding becomes difficult, and this deteriorates manufacturing work efficiency. The present invention was made in consideration of the above problems, and an object of the present invention is to provide a railcar capable of enduring a high compressive load.

Solution to Problem

A railcar according to one aspect of the present invention includes: a pair of side sills extending in a railcar longitudinal direction; end beams respectively located at railcar-longitudinal-direction end portions of the side sills to extend in a railcar width direction; bolster beams located at a railcar-longitudinal-direction inner side of the end beams to extend in the railcar width direction and respectively placed on bogies; center sills each located between the end beam and the bolster beam to extend in a railcar longitudinal direction; a plurality of cross beams located at a railcar-longitudinal-direction inner side of the bolster beams to extend in the railcar width direction; and a corrugated plate fixed to upper surfaces of the cross beams to be displaceable relative to the bolster beams in the railcar longitudinal direction.

According to this configuration, since the corrugated plate is provided so as to be displaceable relative to the bolster beams, the compressive load acting on the corrugated plate from the underframe can be reduced, so that the corrugated plate can be prevented from budding or permanently deforming.

Advantageous Effects of Invention

The above-described railcar can endure a high compressive load.

DESCRIPTION OF EMBODIMENTS

Hereinafter, embodiments will be explained in reference to the drawings. In the following explanations and drawings, the same reference signs are used for the same or corresponding components, and a repetition of the same explanation is avoided.

Schematic Entire Configuration

Figure 1:
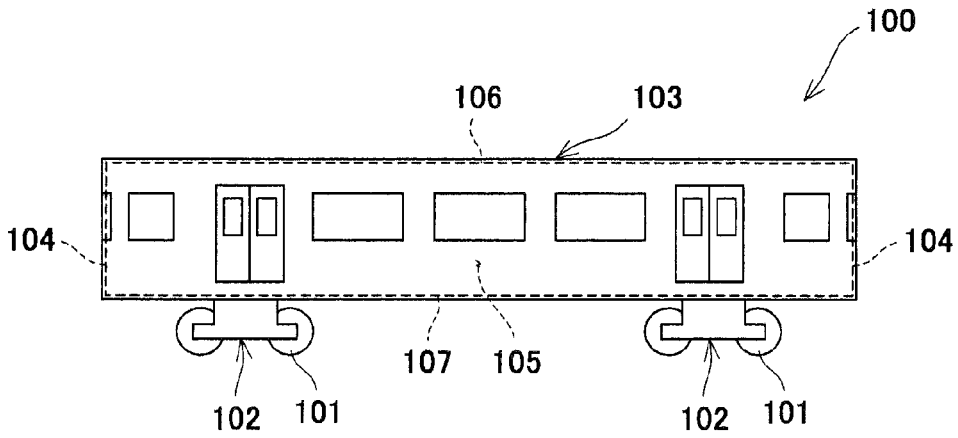
FIG. 1 is a schematic side view of a railcar according to an embodiment.

FIG. 1 is a schematic side view of a railcar 100 according to the present embodiment. A left-right direction on the sheet of FIG. 1 corresponds to a longitudinal direction of the railcar 100, and a direction toward the sheet of FIG. 1 corresponds to a width direction of the railcar 100. In the following explanations, the longitudinal direction of the railcar 100 is simply referred to as a "railcar longitudinal direction", and the width direction of the railcar 100 is simply referred to as a "railcar width direction".

As shown in FIG. 1, the railcar 100 includes bogies 102 and a carbody 103 provided on the bogies 102. The carbody 103 is made of, for example, stainless steel and includes: end bodyshells 104 that are end panels; side bodyshells 105 that are side panels; a roof bodyshell 106 that is a roof; and an underframe (floor bodyshell) 107 that is a floor portion. The underframe 107 is a portion to which the bogies 102 are attached, and a below-described corrugated plate 60 (such as a keystone plate or a corrugated plate) is fixed to an upper surface of the underframe 107 (see FIG. 2).

Figure 2:
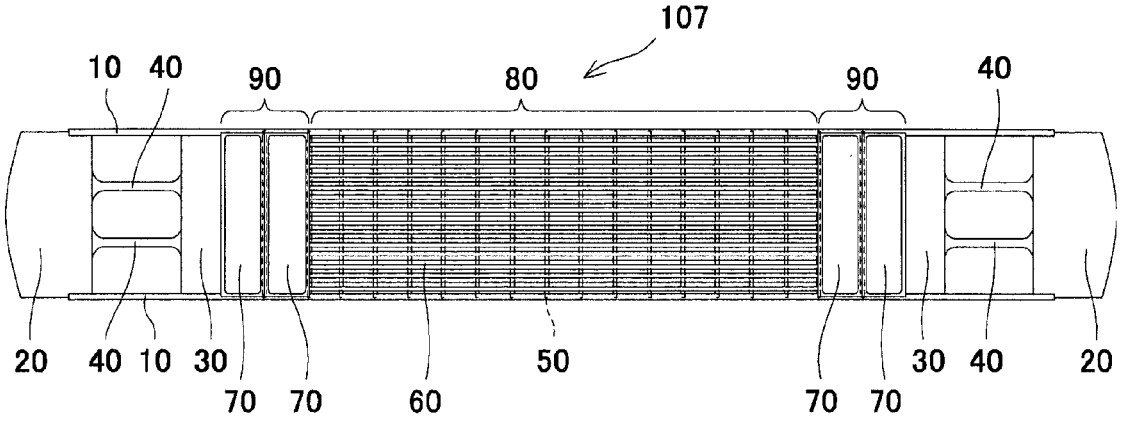
FIG. 2 is a plan view of an underframe on which a corrugated plate according to the embodiment is placed.
Figure 3:
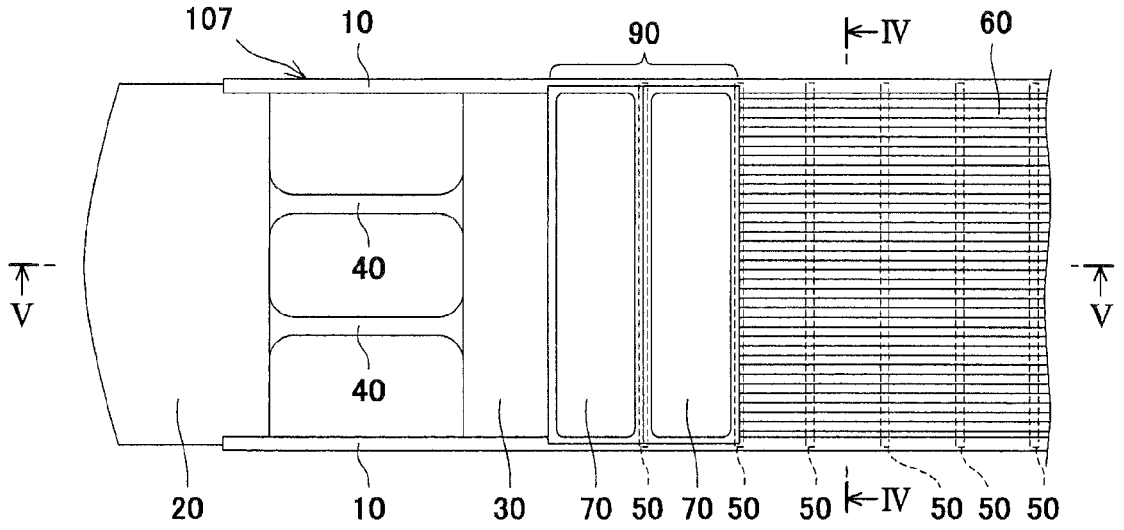
FIG. 3 is a partially enlarged view of FIG. 2.

FIG. 2 is a plan view of the underframe 107 at which the corrugated plate 60 and floor pans 70 are arranged. FIG. 3 is an enlarged view showing the vicinity of one of railcar-longitudinal-direction end portions of the underframe 107 shown in FIG. 2. As shown in FIGS. 2 and 3, the underframe 107 includes side sills 10, end beams 20, bolster beams 30, center sills 40, and cross beams 50. Further, the underframe 107 of the railcar 100 includes a corrugated plate portion 80 at which the corrugated plate 60 is arranged and floor pan portions 90 at which floor pans 70 are arranged. Hereinafter, these components will be explained in order.

Schematic Configuration of Underframe

Figure 4:
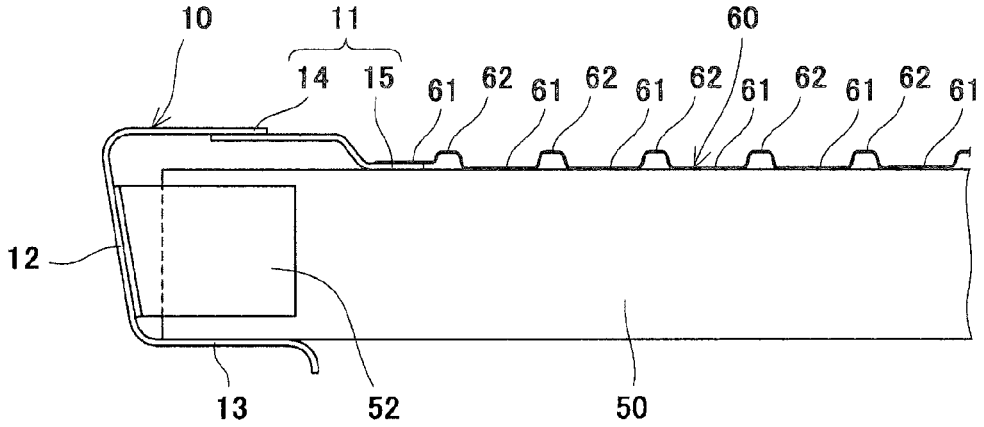
FIG. 4 is a cross-sectional view taken along line IV-IV of FIG. 3.

The side sills 10 are members respectively located at railcar-width-direction end portions of the underframe 107. As shown in FIG. 2, the side sills 10 are respectively located at both railcar-width-direction end portions, form a pair, and extend in the railcar longitudinal direction. FIG. 4 is a cross-sectional view taken along line IV-IV of FIG. 3. FIG. 4 shows only the vicinity of one of railcar-width-direction end portions of the underframe 107. As shown in FIG. 4, the side sill 10 has a shape that is open toward an inner side in the railcar width direction. The side sill 10 is mainly constituted by: an upper surface portion 11 located at an upper side; a side surface portion 12 coupled to the upper surface portion 11; and a lower surface portion 13 coupled to the side surface portion 12 and opposed to the upper surface portion 11. The upper surface portion 11 includes: an upper stage portion 14 located at an outer side in the width direction; and a lower stage portion 15 located at a lower side of the upper stage portion 14 and an inner side of the upper stage portion 14 in the railcar width direction. In the present embodiment, a part of the upper stage portion 14, the side surface portion 12, and the lower surface portion 13 are integrally, seamlessly formed, and as a member separated from this integrated portion, the upper stage portion 14 and the lower stage portion 15 are provided. However, the side surface portion 12, the lower surface portion 13, the upper stage portion 14, and the lower stage portion 15 may be integrally formed. Although not shown in FIG. 4, the side sill 10 located at the other side in the railcar width direction has the same configuration as above.

Figure 5:
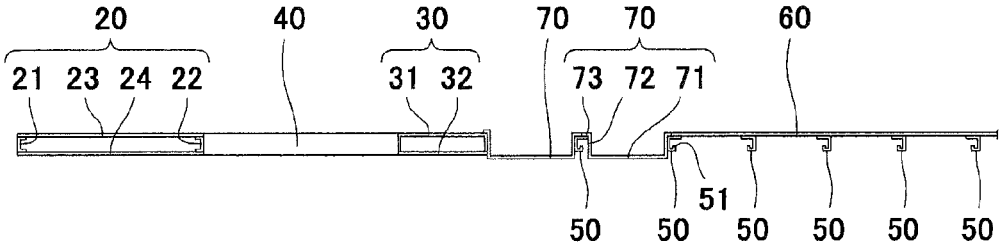
FIG. 5 is a cross-sectional view taken along line V-V of FIG. 3.

The end beams 20 are members that are respectively located at the railcar-longitudinal-direction end portions of the underframe 107 and directly receive the compressive load. As shown in FIG. 3, each of the end beams 20 is arranged so as to extend between the side sills 10 respectively located at both sides in the railcar width direction. FIG. 5 is a cross-sectional view taken along line V-V of FIG. 3. As shown in FIG. 5, the end beam 20 of the present embodiment has a box shape. More specifically, the end beam 20 is mainly constituted by: an end member 21 located at an outermost side in the railcar longitudinal direction, extending in the railcar width direction so as to curve, and having a C-shaped cross section; a groove-shaped steel member 22 located at a railcar-longitudinal-direction inner side of the end member 21 and having a linear shape and a C-shaped cross section; an upper surface plate 23 arranged so as to extend between an upper surface of the end member 21 and an upper surface of the groove-shape steel member 22; and a lower surface plate 24 located at a lower surface side of the end member 21 and a lower surface side of the groove-shape steel member 22 and opposed to the upper surface plate 23. The configuration of the end beam 20 is not limited to this. For example, the end beam 20 may be just constituted by a rod-shaped member. Further, various configurations are applicable to the end beam 20.

The bolster beams 30 are members which are located at an railcar-longitudinal-direction inner side of the end beams 20 and to which the bogies 102 are respectively fixed. To be specific, the bogies 102 are respectively located under the bolster beams 30. As shown in FIG. 3, the bolster beam 30 extends in the railcar width direction and is arranged so as to extend between the side sills 10 located at both sides in the railcar width direction. Further, as shown in FIG. 5, the bolster beam 30 of the present embodiment has a box shape. More specifically, the bolster beam 30 is a member formed by joining a channel member 31 having a C-shaped cross section and a flat plate 32. The configuration of the bolster beam 30 is not limited to this, and the other configuration may be adopted.

The center sills 40 are members arranged so as to extend between the end beam 20 and the bolster beam 30. The center sills 40 of the present embodiment are provided between the end beam 20 and the bolster beam 30 to be respectively located at two positions close to a railcar-width-direction middle portion. The center sills 40 extend in the railcar longitudinal direction. As above, the end beam 20 and the bolster beam 30 are coupled to each other via the center sills 40. Therefore, if the compressive load is applied to the end beam 20, the load is transferred through the center sills 40 to the bolster beam 30. To be specific, relative positions of the end beam 20, the bolster beam 30, and the center sills 40 change little even if external force is applied. Thus, the end beam 20, the bolster beam 30, and the center sills 40 can be regarded as a single rigid body. In FIGS. 2 and 3, no members are shown at a position between the center sills 40 and a position between the center sill 40 and the side sill 10. However, a plate member, a below-described floor pan, and the like may be arranged at these positions.

The cross beams 50 are members located at a railcar-longitudinal-direction inner side of the bolster beams 30. As shown in FIG. 2, the cross beams 50 are provided between the bolster beams 30, respectively located at railcar-longitudinal-direction front and rear sides of the underframe 107, so as to be respectively located at plural positions at intervals. The cross beams 50 extend in the railcar width direction so as to be provided between the side sills 10 located at both railcar-width-direction sides. As shown in FIG. 5, each of the cross beams 50 of the present embodiment has a C-shaped cross section and includes: an upper surface portion joined to the corrugated plate 60; and a lower surface portion spaced apart from the upper surface portion and including a lip 51 located at an end portion thereof (see FIG. 6). A length of the upper surface portion in the railcar longitudinal direction is larger than a length of the lower surface portion in the railcar longitudinal direction. As shown in FIG. 4, a railcar-width-direction end portion of the cross beam 50 is inserted in the side sill 10. A lower surface of the cross beam 50 and an upper surface of the lower surface portion 13 of the side sill 10 contact each other to be fixed to each other, and an upper surface of the cross beam 50 and a lower surface of the lower stage portion 15 of the side sill 10 contact each other to be fixed to each other. The cross beam 50 and the side sill 10 are coupled to each other also by a coupling member 52 formed by bending a flat plate and having an L shape in plan view. Specifically, one side of the coupling member 52 is fixed to the cross beam 50, and the other side thereof is fixed to the side sill 10. With this, the cross beam 50 and the side sill 10 are coupled to each other. The above-described members are joined to each other by, for example, spot welding or plug welding.

Schematic Configuration of Corrugated Plate Portion

Figure 6:
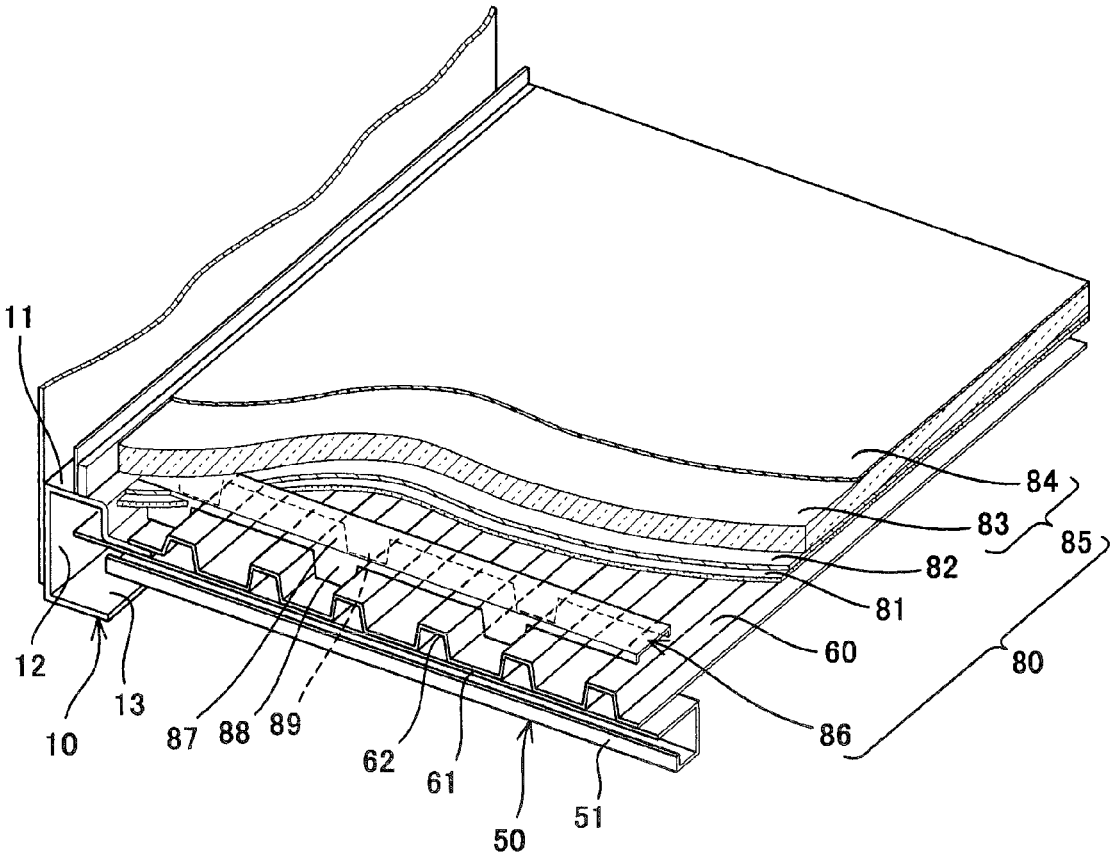
FIG. 6 is a cross-sectional perspective view of a floor portion (underframe) of the railcar shown in FIG. 1.
Figure 7:
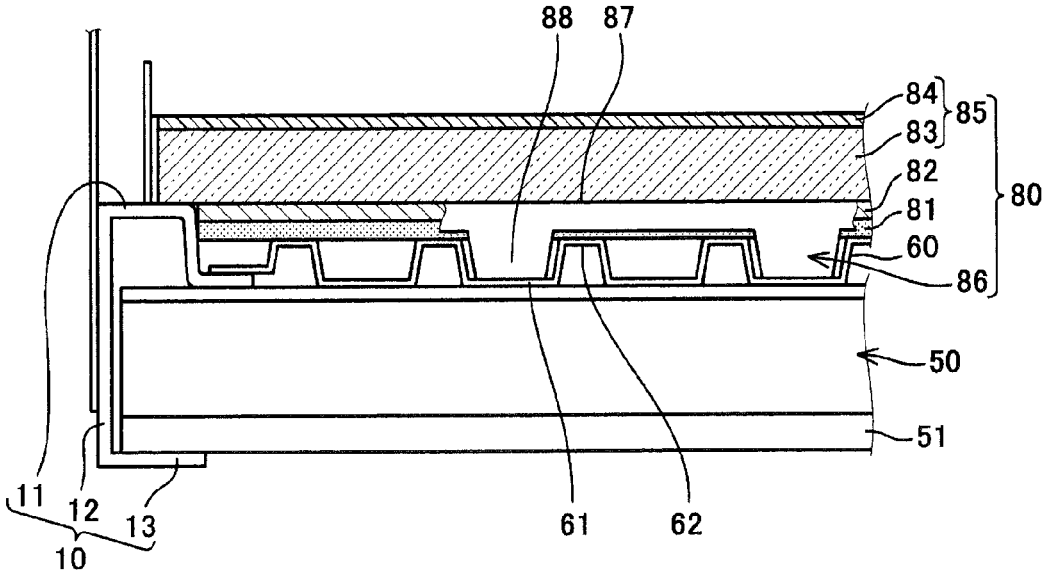
FIG. 7 is a partially cross-sectional view of the floor portion (underframe) shown in FIG. 6.

Next, a schematic configuration of the corrugated plate portion 80 will be explained. FIG. 6 is a cross-sectional perspective view of the floor portion (underframe) of the railcar 100 according to the present embodiment. FIG. 7 is a partial cross-sectional view of the floor portion (underframe) shown in FIG. 6. As shown in FIGS. 6 and 7, the corrugated plate portion 80 includes the corrugated plate 60, a heat absorbing layer 81, a heat dispersing layer 82, a floor panel 85 (a floor plate 83 and a surface sheet 84), and receiving members 86.

The corrugated plate 60 is a plate member fixed to the upper surface of the underframe 107. The corrugated plate 60 is made of, for example, stainless steel. As shown in FIG. 4, the corrugated plate 60 has a corrugated structure in which bottom surface portions 61 and convex portions 62 are alternately, continuously formed in the railcar width direction. The bottom surface portion 61 and the convex portion 62 are parallel to each other and extend in the railcar longitudinal direction. Other than the corrugated plate having the shape shown in FIG. 4, the corrugated plate may be a so-called keystone plate having a keystone structure in which a distance between the adjacent convex portions 62 increases as the convex portions 62 extend downward. Since the corrugated plate 60 is configured as above, the corrugated plate 60 is higher in strength than a flat plate having the same thickness as the corrugated plate 60.

The corrugated plate 60 is arranged as below. To be specific, as shown in FIGS. 2 and 3, the corrugated plate 60 is arranged such that: each of railcar-longitudinal-direction end portions thereof is located at an upper surface of the cross beam 50 next to the cross beam 50 located at an outermost side in the longitudinal direction; and railcar width direction end portions thereof are respectively located at upper surfaces of the side sills 10. Since the corrugated plate 60 is arranged as above, the corrugated plate 60 does not contact the bolster beams 30. According to this configuration, even if a high compressive load acts on the underframe 107, a railcar-longitudinal-direction load is not directly applied from the bolster beam 30 to the corrugated plate 60. In addition, the compressive load is transferred to the side sills 10 respectively located at both railcar-width-direction ends and also dispersedly transferred to the side bodyshells, not shown. Therefore, the compressive load transferred to the corrugated plate 60 can be reduced. According to the above configuration, the corrugated plate 60 can be prevented from buckling or permanently deforming. In the present embodiment, the corrugated plate 60 is arranged so as not to contact the bolster beam 30. However, even if the corrugated plate 60 and the bolster beam 30 contact each other, the same effects as above can be obtained by providing the corrugated plate 60 such that the corrugated plate 60 is displaceable relative to the bolster beam 30. For example, in a case where the corrugated plate 60 is just placed on an upper surface of the bolster beam 30, and the corrugated plate 60 and the bolster beam 30 are not fixed to each other, the compressive load is not directly transferred from the bolster beam 30 to the corrugated plate 60.

The corrugated plate 60 is fixed to the underframe 107 as below. To be specific, as shown in FIG. 4, the bottom surface portions 61 of the corrugated plate 60 and an upper surface of the cross beam 50 contact each other to be fixed to each other. Further, the bottom surface portion 61 of the railcar width direction end portion of the corrugated plate 60 and an upper surface of the lower stage portion 15 of the side sill 10 contact each other to be fixed to each other. These members are joined to each other by series spot welding. As above, the railcar 100 according to the present embodiment is configured such that the corrugated plate 60 hardly buckles or hardly, permanently deforms. Therefore, the thickness of the corrugated plate 60 can be set to such a thickness (for example, 0.8 mm) that the series spot welding can be performed. As a result, the corrugated plate 60 and the underframe 107 can be joined to each other by series spot welding, so that workability improves. Since the railcar 100 according to the present embodiment is configured such that the corrugated plate 60 hardly buckles or hardly, permanently deforms, the wave height of the corrugated plate 60 can be suppressed to be small (for example, about 13 mm).

When the railcar 100 is jacked up, a torsional load acts on the carbody 103. In the present embodiment, as shown in FIG. 2, although the corrugated plate 60 is not provided over the entire length of the carbody, the corrugated plate 60 is fixed to the most part of the underframe 107. Therefore, the strength of the carbody 103 with respect to the torsional load can be improved. The corrugated plate 60 may be formed by a single seamless plate member or by joining a plurality of corrugated plates separated in the railcar width direction.

The heat absorbing layer 81 is a layer that absorbs heat. As shown in FIG. 7, the heat absorbing layer 81 is stacked on an upper surface of the corrugated plate 60. The heat absorbing layer 81 is formed such that a heat absorbing material is dispersed inside ceramic wool. In the present embodiment, used as the heat absorbing material is vermiculite that is a heat expansion material. As the heat absorbing material (vermiculite) expands with heat, the entire heat absorbing layer 81 of the present embodiment also expands. The heat absorbing material used in the heat absorbing layer 81 may be a material other than the vermiculite. It is desirable that a heat absorption start temperature of the heat absorbing material be 350° C. to 550° C. This is because if the heat absorbing material starts absorbing heat at a too low temperature, it cannot adequately achieve its function. For example, a heat-resistant heat-insulating material M20A produced by Sumitomo 3M Ltd. can be used as the heat absorbing layer 81.

The heat dispersing layer 82 is a layer that disperses heat in a surface direction. As shown in FIG. 7, the heat dispersing layer 82 is stacked on an upper surface of the heat absorbing layer 81. The heat dispersing layer 82 is constituted by a heat insulating material. The heat insulating material constituting the heat dispersing layer 82 is not especially limited, and glass wool, ceramic wool, or the like may be used. Since the heat dispersing layer 82 is constituted by the heat insulating material as described above, the heat dispersing layer 82 has not only an effect of dispersing heat but also a heat insulating effect. A difference between the "heat absorbing material" contained in the heat absorbing layer 81 and the "heat insulating material" forming the heat dispersing layer 82 will be simply explained below. That is, the heat absorbing material is a material that performs an endothermic reaction of absorbing heat whereas the heat insulating material does not absorb heat and is just a material to which heat is hardly conducted.

The floor plate 83 is a member configured to secure the stiffness of the floor portion and is a so-called base material. The floor plate 83 according to the present embodiment is formed by a foamed synthetic resin material. The floor plate 83 is located at an upper side of the heat dispersing layer 82, and the thickness of the floor plate 83 is the largest among the members stacked on the corrugated plate 60. The material that forms the floor plate 83 is not limited to the foamed synthetic resin material. Instead of this, a known material, such as wood or a light-alloy honeycomb material, used in the floor panel may be used as the material of the floor plate 83. A railcar-width-direction end portion of the floor plate 83 is mounted on the upper stage portion 14 of the side sill 10. Then, a portion of the floor plate 83 other than the railcar-width-direction end portion is supported by the receiving members 86. Since the floor plate 83 is supported by the receiving members 86 as above, the floor plate 83 is stably supported. To be specific, in a case where the floor plate 83 is directly placed on the heat absorbing layer 81 and the heat dispersing layer 82, which are soft (each of which has the small elastic modulus) without using the receiving members 86, the floor plate 83 may become unstable, and the flatness of the floor panel 85 may not be able to be maintained. This can be prevented by using the receiving members 86.

The surface sheet 84 is a laid member that is laid on an upper surface of the floor plate 83. The surface sheet 84 is, for example, a rubber sheet and can reduce the impact generated, for example, when passengers walk. In addition, the surface sheet 84 prevents noises and vibrations, generated from devices arranged under the floor, from being transferred to the passenger room. The surface sheet 84 is not limited to the rubber sheet. Instead of this, a laid member, such as a vinyl chloride resin sheet, an olefine resin sheet, or a carpet, typically used in railcars can be used as the surface sheet 84.

The receiving members 86 are members that extend in the railcar width direction and support the floor panel 85. The receiving members 86 are made of, for example, stainless steel. The receiving members 86 are arranged so as to respectively correspond to the positions of the cross beams 50 (that is, be respectively arranged above the cross beams 50). Further, the receiving member 86 includes a floor plate contact surface 87 corresponding to an upper surface portion thereof. Further, the receiving member 86 includes leg portions extending from a railcar-longitudinal-direction front end of the floor plate contact surface 87 to the bottom surface portions 61 of the corrugated plate 60. The leg portions include: a plurality of front leg portions 42 corresponding to first leg portions; and a plurality of rear leg portions 89 (see FIG. 6) corresponding to second leg portions and extending from a railcar-longitudinal-direction rear end of the floor plate contact surface to the bottom surface portions 61 of the corrugated plate 60. As above, the front leg portions 88 and the rear leg portions 89 are provided so as to correspond to the bottom surface portions 61. However, the front leg portions 88 and the rear leg portions 89 do not correspond to all the bottom surface portions 61. In order to reduce the weight, the front leg portions 88 and the rear leg portions 89 are provided so as to correspond to alternate bottom surface portions 61 in the railcar width direction. At a position where the receiving member 86 is arranged, the receiving member 86 and the convex portion 62 of the corrugated plate 60 are spaced apart from each other. Therefore, force, such as the passenger loads, are applied from the leg portions to the cross beams 50 via the bottom surface portions 61. Thus, the loads acting on the corrugated plate 60 can be reduced.

Schematic Configuration of Floor Pan Portion

The floor pan portion 90 includes the floor pans 70. As shown in FIG. 3, the floor pans 70 are members arranged at a space surrounded by the side sills 10, the bolster beam 30, and the cross beam 50. Especially, in the present embodiment, a first floor pan 70 is arranged between the bolster beam 30 and the cross beam 50 at which the corrugated plate 60 is not arranged, and a second floor pan 70 is arranged between the cross beams 50 at which the corrugated plate 60 is not arranged.

As shown in FIG. 5, the floor pan 70 is a member having a so-called bathtub structure and made of, for example, stainless steel. Specifically, the floor pan 70 is mainly constituted by: a bottom portion 71 having a rectangular plate shape; a tubular side wall portion 72 extending upward from an outer edge of the bottom portion 71; and an annular flange portion 73 extending outward from an upper end portion of the side wall portion 72. The flange portion 73 is fixed to an upper surface of the bolster beam 30 or an upper surface of the cross beam 50.

A soundproof material (containing a sound insulating material, a sound absorbing material, a damping material, and a heat resisting material) is provided inside the floor pan 70. As described above, since the floor pan 70 is arranged in the vicinity of the bolster beam 30, sound, vibration and the like transferred from the bogie 102 to the railcar inner space can be efficiently reduced. Here, the stiffness of the floor pan 70 itself is low. Therefore, even in a case where the high compressive load acts on the underframe 107 to be transferred to the bolster beam 30, the load is not practically transferred through the floor pan 70 to the cross beam 50 and the corrugated plate 60.

After the corrugated plate 60 and the floor pans 70 are arranged on the underframe 107, the heat absorbing layer and the heat insulating layer are arranged on the upper surfaces of the corrugated plate 60 and the floor pans 70. Further, the floor plate made of, for example, synthetic resin is arranged on the heat absorbing layer and the heat insulating layer, and the surface sheet (laid member) made of, for example, rubber is stacked on the upper surface of the floor plate.

Effects of Respective Configurations

As above, a railcar according to the present embodiment includes: a pair of side sills extending in a railcar longitudinal direction; end beams respectively located at railcar-longitudinal-direction end portions of the side sills to extend in a railcar width direction; bolster beams located at a railcar-longitudinal-direction inner side of the end beams to extend in the railcar width direction and respectively placed on bogies; center sills each located between the end beam and the bolster beam to extend in a railcar longitudinal direction; a plurality of cross beams located at a railcar-longitudinal-direction inner side of the bolster beams to extend in the railcar width direction; and a corrugated plate fixed to upper surfaces of the cross beams to be displaceable relative to the bolster beams in the railcar longitudinal direction.

According to this configuration, since the corrugated plate is provided so as to be displaceable relative to the bolster beams, the compressive load acting on the corrugated plate from the underframe can be reduced, so that the corrugated plate can be prevented from buckling or permanently deforming. Further, according to the railcar of the present embodiment, the force of the compressive load is hardly applied to the corrugated plate. Therefore, the thickness and wave height of the corrugated plate do not have to be increased. On this account, the thickness of the corrugated plate can be reduced to such a thickness that the spot welding can be performed, and the wave height of the corrugated plate can also be suppressed to be small. Thus, the railcar inner space can be increased. Further, according to the railcar of the present embodiment, since the corrugated plate is fixed to the underframe, the adequate stiffness can be secured with respect to the torsional load acting on the carbody.

In addition to the above configuration, the railcar according to the present embodiment may be configured such that: each of the cross beams includes an upper surface portion joined to the corrugated plate and a lower surface portion separated from the upper surface portion; and a length of the upper surface portion in the railcar longitudinal direction is larger than a length of the lower surface portion in the railcar longitudinal direction. According to this configuration, the upper surface portion of each cross beam and the corrugated plate can be joined to each other by spot welding at at least two positions in the railcar longitudinal direction. Therefore, the strength of the corrugated plate portion can be improved.

In addition to the above configuration, the railcar according to the present embodiment may be configured such that the corrugated plate is fixed to the upper surfaces of the cross beams and does not contact the bolster beams. According to this configuration, even if the high compressive load acts, the load can be prevented from acting from the bolster beams to the corrugated plate.

In addition to the above configuration, the railcar according to the present embodiment may be configured such that the corrugated plate is arranged such that railcar-longitudinal-direction end portions thereof are located at a railcar-longitudinal-direction inner side of the bolster beams. According to this configuration, since the corrugated plate is arranged at a railcar-longitudinal-direction inner side of the bolster beams, the compressive load transferred to the bolster beams can be prevented from acting on the corrugated plate. In addition, the compressive load acting on the underframe is applied separately to the side sills respectively arranged at both ends and further dispersedly applied to the side bodyshells. Therefore, the compressive load acting on the corrugated plate can be significantly reduced.

In addition to the above configuration, the railcar according to the present embodiment may further include floor pans each located between the bolster beam and the railcar-longitudinal-direction end portion of the corrugated plate. Further, the railcar according to the present embodiment may be configured such that a first floor pan of the floor pans, the cross beam, and a second floor pan of the floor pans are arranged in this order from the bolster beam toward a railcar-longitudinal-direction inner side. According to this configuration, a soundproof material and the like can be spread in the floor pan arranged at a position through which noises from the bogie is most transferred to the railcar inner space. Therefore, the noises can be efficiently reduced. Since the floor pan is low in stiffness, the compressive load is transferred little from the bolster beams through the floor pans to the corrugated plate. Especially, since the first floor pan, the cross beam, the second floor pan, and the corrugated plate are arranged in this order from the bolster beam in the railcar longitudinal direction, a distance between the corrugated plate and each bolster beam can be secured. With this, the compressive load can be prevented from acting on the corrugated plate.

The foregoing has explained the embodiments in reference to the drawings. However, specific configurations are not limited to these embodiments. Design changes and the like within the scope of the present invention are included in the present invention.

INDUSTRIAL APPLICABILITY

Since the railcar according to the present invention can endure the high compressive load, it is useful in the technical field of railcars.

REFERENCE SIGNS LIST

10 side sill
20 end beam
30 bolster beam
40 center sill
50 cross beam
60 corrugated plate
70 floor pan
80 corrugated plate portion
90 floor pan portion
100 railcar
102 bogie
103 railcar main body

The invention claimed is:

1. A railcar comprising:
a pair of side sills extending in a railcar longitudinal direction;
end beams respectively located at railcar-longitudinal-direction end portions of the side sills to extend in a railcar width direction;
bolster beams located at a railcar-longitudinal-direction inner side of the end beams to extend in the railcar width direction and respectively placed on bogies;
center sills each located between the end beam and the bolster beam to extend in a railcar longitudinal direction;
a plurality of cross beams located at a railcar-longitudinal-direction inner side of the bolster beams to extend in the railcar width direction;
a corrugated plate fixed to upper surfaces of the cross beams to be displaceable relative to the bolster beams in the railcar longitudinal direction; and
a floor pan portion including at least one floor pan located between the bolster beam and the cross beam, wherein
the at least one floor pan includes:
a bottom portion;
a tubular side wall portion extending upward from an outer edge of the bottom portion; and
an annular flange portion extending outward from an upper end portion of the side wall portion and fixed to an upper surface of the bolster beam and the upper surface of the cross beam.

2. The railcar according to claim 1, wherein:
each of the cross beams includes an upper surface portion joined to the corrugated plate and a lower surface portion separated from the upper surface portion; and
a length of the upper surface portion in the railcar longitudinal direction is larger than a length of the lower surface portion in the railcar longitudinal direction.

3. The railcar according to claim 1, wherein the corrugated plate is fixed to the upper surfaces of the cross beams and does not contact the bolster beams.

4. The railcar according to claim 1, wherein the corrugated plate is arranged such that railcar-longitudinal-direction end portions thereof are located at a railcar-longitudinal-direction inner side of the bolster beams.

5. The railcar according to claim 4, wherein the at least one floor pan is located between the bolster beam and the railcar-longitudinal-direction end portion of the corrugated plate.

6. The railcar according to claim 1, wherein:
the floor pan portion is located at a railcar-longitudinal-direction inner side of the bolster beam and is connected to the bolster beam;
all or a part of the plurality of cross beams are located at a railcar-longitudinal-direction inner side of the floor pan portion; and
among all or a part of the plurality of cross beams, the cross beam located at an outermost side in the railcar longitudinal direction is connected to the floor pan portion.

7. The railcar according to claim 6, wherein:
the corrugated plate is arranged such that railcar-longitudinal-direction end portions thereof are located at a railcar-longitudinal-direction inner side of the bolster beams; and the floor pan portion is located between the bolster beam and the railcar-longitudinal-direction end portion of the corrugated plate.

8. A railcar comprising:

a pair of side sills extending in a railcar longitudinal direction;

end beams respectively located at railcar-longitudinal-direction end portions of the side sills to extend in a railcar width direction;

bolster beams located at a railcar-longitudinal-direction inner side of the end beams to extend in the railcar width direction and respectively placed on bogies;

center sills each located between the end beam and the bolster beam to extend in a railcar longitudinal direction;

a plurality of cross beams located at a railcar-longitudinal-direction inner side of the bolster beams to extend in the railcar width direction;

a corrugated plate fixed to upper surfaces of the cross beams to be displaceable relative to the bolster beams in the railcar longitudinal direction; and a floor pan portion including at least one floor pan located between the bolster beam and the cross beam, wherein the at least one floor pan comprises a first floor pan and a second floor pan;

the plurality of cross beams comprises at least a first cross beam and a second cross beam;

the first floor pan is connected to the bolster beam;

the first cross beam is connected to the first floor pan;

the second floor pan is connected to the first cross beam;

the second cross beam is connected to the second floor pan; and the corrugated plate is fixed to an upper surface of the second cross beam to be displaceable relative to the bolster beam in the railcar longitudinal direction.

9. A railcar comprising:

a pair of side sills extending in a railcar longitudinal direction;

end beams respectively located at railcar-longitudinal-direction end portions of the side sills to extend in a railcar width direction;

bolster beams located at a railcar-longitudinal-direction inner side of the end beams to extend in the railcar width direction and respectively placed on bogies;

center sills each located between the end beam and the bolster beam to extend in a railcar longitudinal direction;

a plurality of cross beams located at a railcar-longitudinal-direction inner side of the bolster beams to extend in the railcar width direction;

a corrugated plate fixed to upper surfaces of the cross beams to be displaceable relative to the bolster beams in the railcar longitudinal direction; and a floor pan portion including at least one floor pan located between the bolster beam and the cross beam, wherein surface portions of both railcar width direction end portions of the corrugated plate and upper surfaces of the pair of side sills are fixed to each other.

* * * * *